United States Patent [19]

Mizuno

[11] 4,074,729

[45] Feb. 21, 1978

[54] APPARATUS FOR SELECTIVELY DETAINING AND RELEASING WEFT YARNS IN WEAVING LOOM

[75] Inventor: Yukio Mizuno, Kodaira, Japan

[73] Assignee: Nissan Motor Company, Limited, Japan

[21] Appl. No.: 728,888

[22] Filed: Oct. 1, 1976

[30] Foreign Application Priority Data

Oct. 5, 1975 Japan ..... 50-120037

[51] Int. Cl.[2] ..... D03D 47/34

[52] U.S. Cl. ..... 139/450; 139/453

[58] Field of Search ..... 139/429, 435, 450, 452, 139/453; 66/125, 132; 242/75; 226/195

[56] References Cited

U.S. PATENT DOCUMENTS

| | | | |
|---|---|---|---|
| 1,943,012 | 1/1934 | Gabler | 139/453 |
| 3,276,482 | 10/1966 | Liebchen | 139/453 |
| 3,299,909 | 1/1967 | Golobart | 139/453 |
| 3,820,574 | 6/1974 | Mizuno | 139/453 |
| 3,885,599 | 5/1975 | Mawdsley et al. | 139/435 |

*Primary Examiner*—Henry S. Jaudon

*Attorney, Agent, or Firm*—Robert E. Burns; Emmanuel J. Lobato; Bruce L. Adams

[57] ABSTRACT

An apparatus for selectively detaining and releasing a plurality of weft yarns of different natures, typically colors, before a weft yarn is drawn off into the shed of warp yarns in a weaving loom, comprising lever actuated weft pinch-off units each having a condition to retain each of the weft yarns and a condition to release the weft yarn, a weft selector mechanism including lever actuating means for moving each of the levers associated with the pinch-off units and cam means for moving the lever actuating means between positions respectively operable on the levers for the individual pinch-off units, and a weft release control mechanism driven in synchronism with other driven members and units of the loom for driving the lever actuating means alternately between positions in which the lever engaged by the actuating means is operative to hold the associated pinch-off unit in the above-mentioned conditions thereof.

18 Claims, 4 Drawing Figures

APPARATUS FOR SELECTIVELY DETAINING AND RELEASING WEFT YARNS IN WEAVING LOOM

The present invention relates to weaving looms and more particularly to an apparatus for selectively detaining and releasing weft yarns to be drawn from yarn packages into the shed of warp yarns in a weaving loom.

A conventional apparatus of this nature typically uses a plurality of weft selector cam units which are respectively associated with the weft retaining units through which the weft yarns are to be selectively drawn off into the weaving shed. Such a cam arrangement is responsible for not only the disproportionately large-sized construction of the apparatus as a whole but for extremely high production and maintenance cost of the apparatus and is not acceptable especially where it is desired to use a number of weft yarns with different natures, usually colours, for weaving operation. Furthermore, each of the weft retaining units of the conventional apparatus is provided with a drive unit which is proper to the particular weft retaining unit. This also results in large-sized construction and high production and maintenance cost of the apparatus.

An object of the present invention is to provide a useful solution to these problems by the use of a single weft selector cam unit and a single drive unit for plurality of weft pinch-off units.

In accordance with the present invention, such an object will be accomplished by an apparatus which comprises, in combination, (1) a weft retaining mechanism comprising a plurality of weft pinch-off units arranged in a row and each having a first condition operative to detain a weft yarn leading from a yarn package and a second condition allowing the weft yarn to be drawn off through the pinch-off unit; and weft release levers respectively in engagement with the weft pinch-off units and each rotatable about a fixed axis between first and second angular positions holding the associated weft pinch-off unit in the first and second conditions thereof, (2) a weft selector mechanism for selecting out of said plurality of weft yarns a weft yarn to be drawn off into the weaving shed under the control of the above-mentioned control means, the selector mechanism comprising weft selector cam means operatively connected to the control means for being driven in accordance with the above-mentioned schedule; weft selector link means in engagement with the cam means; lever actuating means movable with the link means between positions respectively engageable with the weft release levers, the cam means being movable between angular positions respectively holding the link means in the above-mentioned positions thereof; and a guide member for guiding the lever actuating means to move between the above-mentioned positions thereof relative to the guide member, the guide member and the lever actuating means being movable together between first positions operative to hold each of the weft release levers in the first angular position thereof when the weft release lever is being engaged by the lever actuating means and second conditions allowing each of the weft release levers to turn into the second angular positions thereof when the particular weft release lever is being engaged by the lever actuating means, and (3) a weft release control mechanism comprising weft release control cam means rotatable about a fixed axis and having first and second angular positions for driving the aforesaid particular weft release lever into the first and second angular positions, respectively, thereof; and weft release control means in engagement with the weft release control cam means and movably connected to the above-mentioned guide member for converting the rotational motion of the weft release control cam means into linear motion and transmitting the linear motion to the lever actuating means through the guide member. Preferably, the above-mentioned weft release levers are substantially equally dimensioned and have a common rotational axis which is coincident with the aforesaid fixed axis of each weft release lever, wherein the weft pinch-off units are arranged substantially in parallel with the common rotational axis of the weft release levers. In this instance, the lever actuating means is preferably movable on the guide member substantially in parallel with the above-mentioned common rotational axis of the weft release levers. The guide member and the lever actuating means may be arranged to be movable together substantially perpendicularly to the direction in which the lever actuating means is movable on the guide member. More particularly, the guide member may be supported by the weft release control link means, the weft release control link means being configured in such a manner as to constrain the guide member to move on a plane substantially parallel with the above-mentioned common rotational axis of the weft release levers and substantially perpendicularly to the direction in which the lever actuating means is movable on the guide member. The weft release control means of this nature may be constituted by a parallelogrammic four-bar linkage connected to the guide member by two moving pair-members.

The features and advantages of an apparatus according to the present invention will be more clearly appreciated from the following description taken in conjunction with the accompanying drawings in which like reference numerals and characters designate the same portions, members, units and structures and in which.

Figure 1:
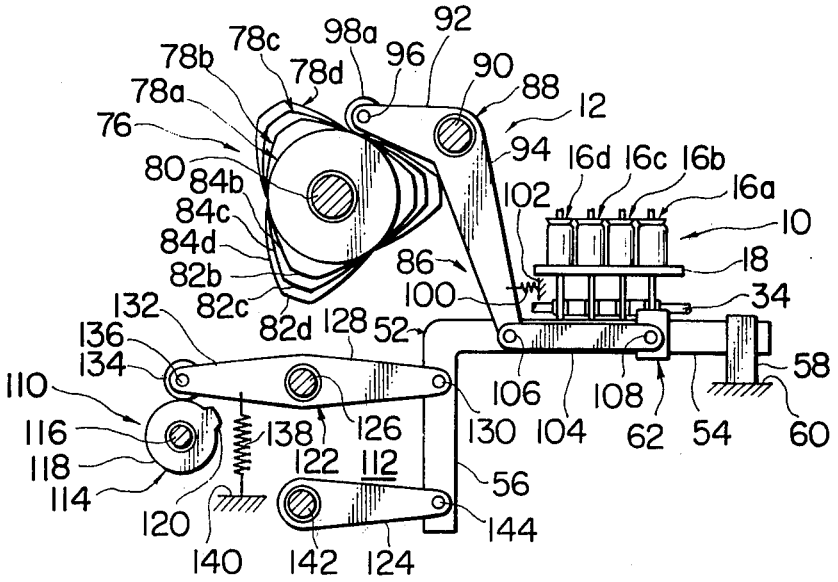
FIG. 1 is a view showing, partly in cross section, a preferred embodiment of an apparatus according to the present invention when viewed backward from the front of the apparatus.

The construction, operation and advantages of an apparatus of the present invention will be hereinafter described in detail with reference to the accompanying drawings. For the sake of clarity, the majority of conventional parts and structures constructing a weaving loom into which the shown embodiment is to be incorporated are omitted from the drawings. It may be however noted that the apparatus according to the present invention is arranged, functionally, between the weaving shed formed by warp yarns and suitable control means, such as a pattern card arrangement, incorporating a predetermined schedule in accordance with which weft yarns of different natures, usually colours, are to be selectively fed into the weaving shed. Furthermore, the relative position of the apparatus embodying the present invention in the weaving loom will be quite apparent to those skilled in the art from the directions in which the weft yarns indicated in phantom by Y*a*, Y*b*, Y*c* and Y*d* in FIG. 4 of the drawing extend.

CONSTRUCTION

Referring concurrently to FIGS. 1 to 4, the apparatus embodying the present largely comprises a weft retaining mechanism 10, a weft selector mechanism 12, and a weft release control mechanism 14.

Figure 2:
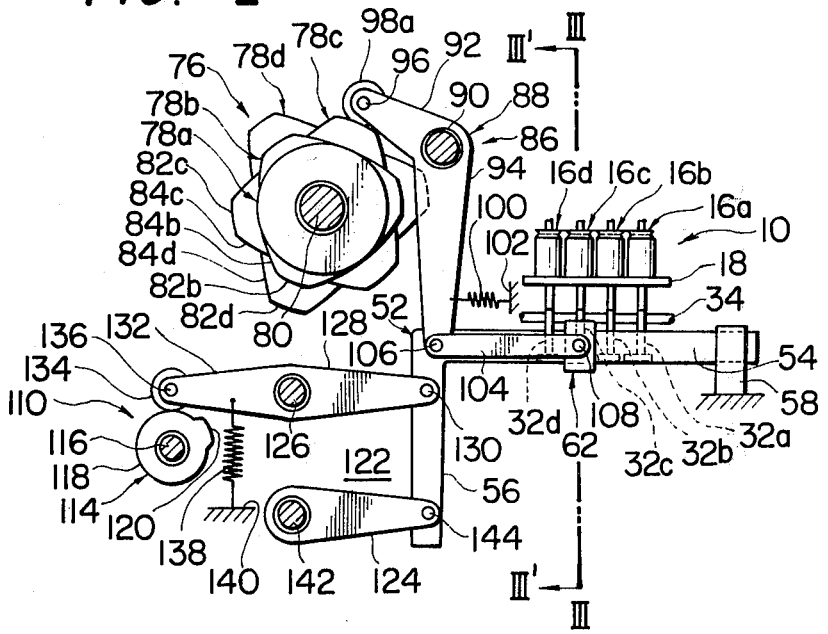
FIG. 2 is a view similar to FIG. 1 but shows the apparatus in another operational condition.
Figure 3:
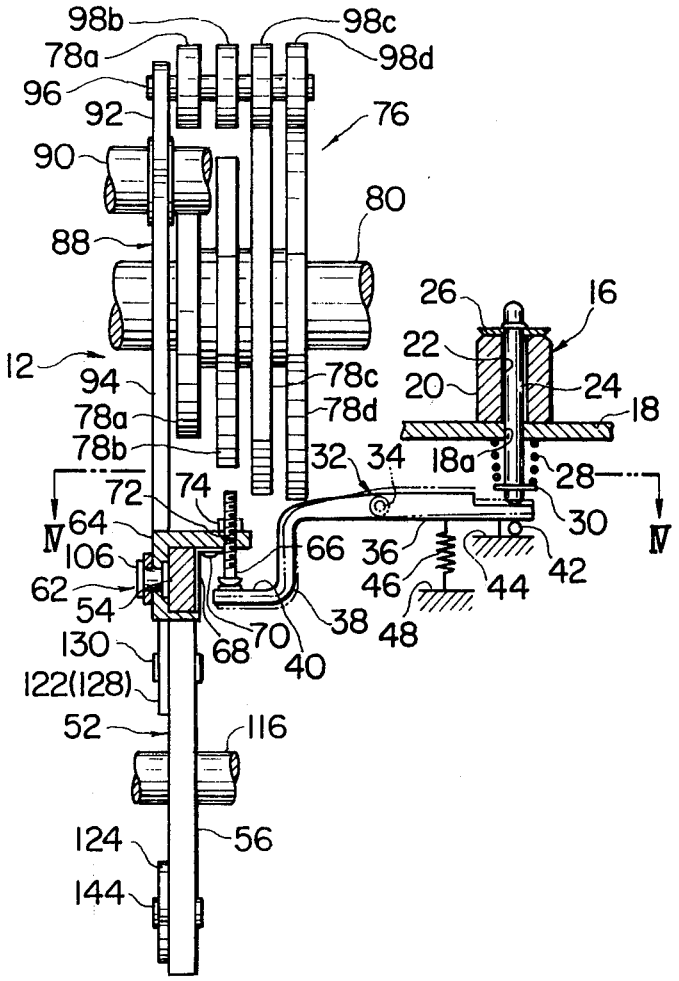
FIG. 3 is a side elevational view showing, to an enlarged scale and partly in section, the apparatus of FIGS. 1 and 2 when viewed from a vertical plane indicated by III—III in a direction indicated by III'—III' in FIG. 2.

As will be best seen in FIG. 1, the weft retaining-mechanism 10 comprises a plurality of weft pinch-off units 16*a*, 16*b*, 16*c* and 16*d* which are fixedly supported on the upper face of a stationary horizontal support member 18. The pinch-off units 16*a*, 16*b*, 16*c* and 16*d* will be referred to as first, second, third and fourth pinch-off units, respectively, where necessary. The support member 18 is formed with holes (one of which is seen at 18*a* in FIG. 3) having vertical center axes which are arranged in a row and which are substantially equidistantly spaced apart from each other as will be understood from FIG. 4. The weft pinch-off units 16*a*, 16*b*, 16*c* and 16*d* are all constructed and dimensioned similarly to each other and are commonly represented by a weft pinch-off unit 16 which is shown to an enlarged scale in FIG. 3. In FIG. 3, the weft pinch-off unit 16 is shown comprising a generally cylindrical stationary member 20 formed an axial bore 22 which is open at the upper and lower axial ends of the member 20 and which is assumed to have a center axis substantially coincident with the center axis of the stationary member 20. The stationary member 20 is fixedly mounted on the upper face of the support member 18 with the axial bore 22 in line with the hole 18*a* in the support member. A control rod 24 axially extends through the bore 22 in the stationary member 20 and projects upwardly from the upper end of the stationary member 20 and downwardly from the lower face of the support member 18. The control rod 24 is vertically movable through the bore 22 in the stationary member 20 and the hole 18*a* in the support member 18. An annular movable member 26 is vertically movable above the stationary member 20 and is fixedly mounted on an upper end portion of the control rod 24. The movable member 26 has a lower face substantially parallel with the upper end face of the stationary member 20. The lower face of the movable member 26 is assumed, by way of example, to be substantially coextensive with the upper end face of the stationary member 20. The control rod 24 is urged downwardly and accordingly, the stationary member 20 is biased to have its lower face in contact with the upper end face of the stationary member 20 by suitable biasing means which is shown comprising a helical compression spring 28 which is seated at one end on the lower face of the support member 18 and at the other end on the upper face of an annular spring seat element 30 which is fixedly mounted on a lower end portion of the control rod 24. Each of the previously mentioned weft yarns Y*a*, Y*b*, Y*c* and Y*d* is horizontally passed between the upper end face of the stationary member 20 and the lower face of the annular movable member 26 as will be seen from FIG. 4 so that each weft yarn is securely detained therebetween when the movable member 26 is forced against the upper end face of the stationary member 20 by the force of the spring 28. Such a condition of the weft pinch-off unit 16 will be hereinafter referred to as a first condition of the unit for each of the pinch-off units 16*a*, 16*b*, 16*c* and 16*d* shown in FIGS. 1 to 3. The weft yarn thus retained to the pinch-off unit 16 is allowed to move relative to the unit and becomes ready to be drawn off through the unit when the control rod 24 is moved upwardly against the force of the spring 28 so that the movable member 26 is raised over the upper end face of the stationary member 20. This condition of the weft pinch-off unit 16 will be hereinafter referred to as a second condition of the unit for each of the pinch-off units 16*a*, 16*b*, 16*c* and 16*d* shown in FIGS. 1 to 3. As will be seen from FIGS. 1 to 3, the control rods 24 of the weft pinch-off units 16*a*, 16*b*, 16*c* and 16*d* and, accordingly, the pinch-off units per se are positioned in a row with the center axes of the control rod 24 situated on a common vertical plane and are substantially equidistantly spaced apart from each other.

Thw weft retaining mechanism 10 further comprises first, second, third and fourth weft release levers 32*a*, 32*b*, 32*c* and 32*d* which are provided in association with the above described first, second, third and fourth weft pinch-off units 16*a*, 16*b*, 16*c* and 16*d*, respectively. The weft release levers 32*a*, 32*b*, 32*c* and 32*d* are rotatable independently of each other on a common stationary shaft 34 having a horizontal axis substantially parallel with the above-mentioned vertical plane containing the center axes of the control rods 24 of the pinch-off units 16*a*, 16*b*, 16*c* and 16*d* as will be best seen in FIG. 3. The levers 32*a*, 32*b*, 32*c* and 32*d* are all shaped and dimensioned similarly to each other and are thus commonly represented by a weft release lever 32 in FIG. 3. In FIG. 3, the lever 32 is shown consisting of an intermediate fulcrum portion rotatably mounted on the shaft 34 and first and second arm portions 36 and 38 which extend in substantially opposite directions from the fulcrum portion. The first arm portion 36 terminates below the control rod 24 and has at its free end a substantially horizontal upper flat face with which the above-mentioned control rod 24 of the weft pinch-off unit 16 is held in contact at its lower end. On the other hand, the second arm portion 38 of the lever 32 is shown to consist of a first sub-portion merging substantially horizontally from the fulcrum portion of the lever, a second sub-portion downwardly bent from the first sub-portion, and a third sub-portion extending substantially horizontally from the lower end of the second sub-portion and having a substantially horizontal upper surface portion 40 at its free end. Below the free end of the first arm portion 36 of the lever 32 is positioned a stop member 42 fixedly supported on a suitable stationary wall portion 44 which may form part of the loom construction. The stop member 42 is located so that the lever 32 is brought into abutting engagement with the stop member when the lever is turned clockwise in FIG. 3 about the center axis of the shaft 34 by the control rod 24 moved by the force of the spring 28 into the lowermost position relative to the stationary member 20 with the movable member 24 in close contact with the upper end face of the stationary member 20 as indicated by full lines in FIG. 3. The angular position of the lever 32 thus held in contact with the stop member 42 will be hereinafter referred to as a first angular position of the lever for each of the weft release levers 32*a*, 32*b*, 32*c* and 32*d* shown in FIG. 2. The lever 32 is urged to turn clockwise in FIG. 2 toward the first angular position by suitable biasing means comprising, by way of example, a helical tension spring 46 which is anchored at one end to the first arm portion 36 of the lever and at the other end to a suitable stationary wall portion 48 located below the first arm portion 36 as shown in FIG. 3. As will be understood as the description proceeds, the lever 32 is slightly rotatable counterclockwise in FIG. 3 about the center axis of the shaft 34 into an angular position indicated by phantom lines in FIG. 3. The particular position of the lever 32 will be hereinafter referred to as a second angular position of the lever for each of the weft release levers 32*a*, 32*b*, 32*c* and 32*d* shown in FIG. 4.

On the other hand, the previously mentioned weft selector mechanism 12 comprises a generally L-shaped guide member 52 which consists of an elongated guide rail portion 54 extending in parallel with the shaft 34 carrying the above described weft release levers 32*a*, 32*b*, 32*c* and 32*d* and a link bar portion 56 extending downwardly from one end of the guide rail portion 54. The guide rail portion 54 has one side face located in proximity to but slightly spaced apart from the free ends of the second arm portions 38 of the weft release levers 32*a*, 32*b*, 32*c* and 32*d* as will be best seen in FIG. 4. Furthermore, the guide rail portion 54 of the guide member 52 has a free end portion slidably received between a pair of guide posts 58 and 58' which are mounted on a suitable stationary wall portion 60.

Figure 4:
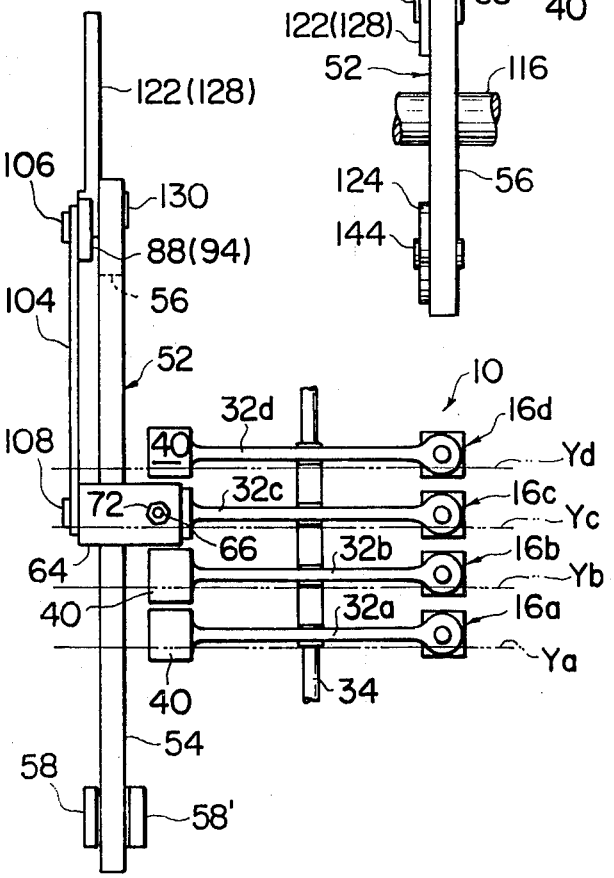
FIG. 4 is a plan view of the apparatus of FIGS. 1 to 3 when viewed downward from a horizontal plane indicated by IV—IV in FIG. 1.

The weft selector mechanism 12 further comprises lever actuating means 62 which comprise, as will be best seen in FIGS. 3 & 4, a movable bracket 64 and an adjustable elongated element 66 having an externally threaded screw portion. The movable bracket 64 is longitudinally slidable on the guide rail portion 54 of the guide member 52 and is shown to have a generally J-shaped cross section consisting of a horizontal upper wall portion slidably received on the upper end face of the guide rail portion 54, a horizontal lower wall portion slidably received on the lower end face of the guide rail portion 54 and a vertical intermediate wall portion slidably received on the side face of the guide rail portion 54 opposite to the weft release levers 32*a*, 32*b*, 32*c* and 32*d*. The upper wall portion of the bracket 64 horizontally projects from the side face of the guide rail portion 54 opposite to the intermediate wall portion of the bracket and terminates with an edge which is located over a previously mentioned upper surface portion 40 of any of the weft release levers 32*a*, 32*b*, 32*c* and 32*d* when the movable bracket 64 is positioned in alignment with the weft release lever, as will be best seen in FIG. 4. The movable bracket 64 is slidably retained to the guide rail portion 54 by suitable means such as a metal strip 68 which is fastened as at 70 to the lower face of the upper wall portion of the bracket 64 and which is received on the side face of the guide rail portion 54 opposite to the intermediate wall portion of the bracket as shown. The movable bracket 64 has formed in its upper wall portion an internally threaded hole 72 having a vertical center axis. The above-mentioned adjustable elongated element 66 has its screw portion in the hole 72 and is held in position relative to the movable bracket 64 by an internally threaded locking element 74, projecting downwardly from the lower face of the upper wall portion of the bracket 64. The adjustable elongated element 66 may be constituted by a bolt with its head at the bottom and, likewise, the above-mentioned locking element 74 may be constituted by a nut. The length with which the elongated element 66 projects downwardly from the lower face of the upper wall portion of the movable bracket 64 is selected so that the element is engageable at its lower end (or at the head of the bolt) on the horizontal upper surface portion 40 of any of the weft release levers 32*a*, 32*b*, 32*c* and 32*d* when the movable bracket 64 is aligned with the weft release lever. As will be understood as the description proceeds, the movable bracket 64 is driven for movement on the guide rail portion 54 of the guide member 52 between four different positions which are aligned with the first, second, third and fourth weft release levers 32*a*, 32*b*, 32*c* and 32*d*. As will also be understood from the description to follow, the guide member 52 and the above described lever actuating means 62 are movable as a single unit in a vertical plane parallel with the previously mentioned vertical plane containing the center axes of the control rods 24 of the weft pinch-off units 16*a*, 16*b*, 16*c* and 16*d* and substantially perpendicularly to the direction in which the bracket 64 is movable on the guide rail portion 54 of the guide member 52.

The weft selector mechanism 12 depends for its operation on the predetermined schedule incorporated into a pattern card arrangement (not shown) or any other control means and, thus, further comprises weft selector cam means 76 which are operatively connected to such means. The weft selector cam means 76 comprises first, second, third and fourth cams 78*a*, 78*b*, 78*c* and 78*d* which are rotatable independently of each other on a stationary cam shaft 80 having a horizontal center axis which is substantially normal to the previously mentioned vertical plane on which the center axes of the control rods 26 of the weft pinch-off units 16*a*, 16*b*, 16*c* and 16*d* are found. The first cam 78*a* has a circular cross section having a predetermined diameter while each of the second, third and fourth cams 78*b*, 78*c* and 78*d* is formed with a plurality of cam lobe portions (herein shown as three in number by way of example) which have equal radii of curvature and equal central angles about the center axis of the cam shaft 80 and which are substantially equiangularly spaced apart from each other about the center axis of the cam shaft 80 across intermediate low arc portions having a common radius of curvature, the cam lobe portions of the second, third and fourth cams 78*b*, 78*c* and 78*d* being designated by 82*b*, 82*c* and 82*d*, respectively, and the low arc portions of the cams 78*b*, 78*c* and 78*d* being designated by 84*b*, 84*c* and 84*d*, respectively in FIGS. 1 and 2. While the respective low arc portions 84*b*, 84*c* and 84*d* of the cams 78*b*, 78*c* and 78*d* have substantially equal radii, the respective cam lobe portions 82*b*, 82*c* and 82*d* of the second, third and fourth cams 78*b*, 78*c* and 78*d* have radii which are larger in this sequence, as will be best seen from FIG. 1. The common radius of the low arc portions 82*b*, 82*c* and 82*d* of the cams 78*b*, 78*c* and 78*d* is substantially equal to the first cam 78*a* as will also be evident from FIG. 1. In the appendant claims, the second, third and fourth cams 78*b*, 78*c* and 78*d* are referred as to "lobular cams" for being distinguished from the first cam 78*a* having a circular cross section.

The weft selector mechanism 12 further comprises weft selector link means 86 which is in engagement with the above described cam means 76 for converting the rotational motion of the weft selector cam means 76 into linear motion and transmitting the linear motion to the above described lever actuating means 62 through the guide member 52. The link means 86 comprises a bell crank lever 88 having an intermediate fulcrum portion rotatably mounted on a stationary shaft 90 having a horizontal center axis substantially parallel with the center axis of the shaft 80 carrying the cams 78*a*, 78*b*, 78*c* and 78*d*. The bell crank lever 88 further has an upper first arm portion 92 slightly upwardly extending from the fulcrum portion of the lever and a lower second arm portion 94 downwardly extending from the fulcrum portion. The first arm portion 92 has supported at its leading end a shaft 96 having a horizontal center axis substantially parallel with the center axes of the shafts 80 and 90. The shaft 96 has mounted thereon first, second, third and fourth cam follower rollers 98*a*, 98*b*, 98*c* and 98*d* which are rotatable, independently of each other, about the center axis of the shaft 96 and which are engageable with the first, second, third and fourth cams 78*a*, 78*b*, 78*c* and 78*d*, respectively, as will be seen from FIG. 3. The bell crank lever 88 is biased to turn clockwise in FIGS. 1 and 2 about the center axis of the shaft 90 by means of suitable biasing means such as a helical tension spring 100 which is anchored at one end to the second arm portion 94 of the lever 88 and at the other end to a suitable stationary wall portion 102 as shown in FIGS. 1 and 2. The cam follower rollers 98*a*, 98*b*, 98*c* and 98*d* are thus biased toward the cam surfaces of the cams 78*a*, 78*b*, 78*c* and 78*d*, respectively. When the second, third and fourth cam follower rollers 98*b*, 98*c* and 98*d* have such angular positions about the center axis of the cam shaft 80 as are concurrently in contact with the low arc portions 84*b*, 84*c* and 84*d* of the second, third and fourth cams 78*b*, 78*c* and 78*d*, respectively, as shown in FIG. 1, the first cam follower roller 98*a* is in contact with the outer peripheral surface of the first cam 78*a* having a circular cross section so that the bell crank lever 88 assumes a counterclockwise extreme rotational position in FIG. 1 about the center axis of the shaft 90. Such an angular position of the bell crank lever 88 is herein referred to as a first angular position of the lever 88 about the center axis of the shaft 90. When the second cam 78*b* is rotated about the center axis of the cam shaft 80 from such conditions and assumes an angular position having one of its cam lobe portions 82*b* in contact with the second roller 98*b*, the shaft 96 carrying the cam follower rollers is moved in an arc away from the center axis of the cam shaft 80 and causes the bell crank lever 88 to turn clockwise in FIGS. 1 and 2 about the center axis of the shaft 90 against the force of the tension spring 100. The angular position of the lever 88 under these conditions is herein referred to as a second angular position of the lever about the center axis of the shaft 90. When the fourth cam 78*d* has an angular position having one of its low arc portions 84*d* facing the fourth cam follower roller 98*d* and simultaneously the third cam 78*c* has an angular position having one of its high arc portions 82*c* in contact with the third cam follower roller 98*c* as shown in FIGS. 2 and 3, the shaft 96 carrying the rollers is further raised away from the center axis of the cam shaft 80 so that the bell crank lever 88 assumes a third angular position about the center axis of the shaft 90 irrespective of the angular positions of the first and second cams 78*a* and 78*b*, as illustrated in FIG. 2. The third angular position of the bell crank lever 88 is in advance of the above-mentioned second angular position of the lever 88 clockwise in FIGS. 1 and 2. When, furthermore, the fourth cam 78*d* is rotated about the center axis of the cam shaft 80 into an angular position having one of its cam lobe portions 82*d* in contact with the fourth cam follower roller 98*d*, the shaft 96 on the bell crank lever 88 is still further raised away from the center axis of the cam shaft 80 so that the lever 88 is further turned clockwise in FIGS. 1 and 2 and assumes a fourth angular position about the center axis of the shaft 90 irrespective of the angular positions of the first, second and third cams 78*a*, 78*b* and 78*c*. The fourth angular position of the bell crank lever 88 is the clockwise extreme rotational position of the lever 88 about the center axis of the shaft 90. The bell crank lever 88 forming part of the link means 60 is thus stepwise rotatable about the center axis of the shaft 90 between the first, second, third and fourth angular positions thereof depending upon the angular positions of the cams 78*a*, 78*b*, 78*c* and 78*d*. As the bell crank lever 88 is rotated between the first, second, third and fourth angular positions thereof about the center axis of the shaft 90, the leading end of the second arm portion 94 of the lever 88 is moved in an arc in approximately horizontal direction. The arm portion 94 of the lever 88 has its leading end located and movable over one side face of the guide rail portion 54 of the previously mentioned guide member 52 and is pivotally connected at the leading end to an elongated link bar 104 by a pin 106 located at one end of the link bar 104. The link bar 104 extends substantially in parallel with the above-mentioned side face of the guide rail portion 54 of the guide member 52 and is pivotally connected at the other end thereof to the previously described movable bracket 64 of the lever actuating means 62 or, more particularly, to the outer side face of the intermediate vertical wall portion of the movable bracket 64 by a pin 108. The pins 106 and 108 having center axes substantially parallel with the center axis of the shaft 90 supporting the bell crank lever 88, the rotational motion of the bell crank lever 88 is converted into linear movement of the link bar 104 relative to the guide member 52. As the link bar 104 is thus moved along the guide rail portion 54 of the guide member 52, the movable bracket 64 pivotally connected to the link bar 104 by the pin 108 is driven to longitudinally move on the guide rail portion 54 between the positions aligned with the weft release levers 32*a*, 32*b*, 32*c* and 32*d*. The respective positions of the movable bracket 64 thus aligned with the first, second, third and fourth weft release levers 32*a*, 32*b*, 32*c* and 32*d* are provided when the bell crank lever 88 is moved into the previously mentioned first, second, third and fourth angular positions, respectively, thereof about the center axis of the shaft 90.

On the other hand, the previously mentioned weft release control mechanism 14 comprises weft release cam means 110 and weft release control link means 112 held in engagement with the cam means 110 for translating the rotational motion of the cam means 110 into linear motion and transmitting the linear motion to the above described guide member 52 and accordingly to the lever actuating means 62. The weft release control cam means 110 comprises an intermittent motion cam 114 rotatable with a cam shaft 116 having a horizontal center axis which is substantially parallel with the center axes of the previously mentioned shafts 80 and 90, viz., substantially perpendicular to the vertical plane on which the guide member 52 is vertically movable. The intermittent motion cam 114 is shown to be formed with a circular arc portion 118 and a radially outwardly protruding cam lobe portion 120. The cam shaft 116 is connected to a suitable drive source (not shown) so that the cam 114 is driven for rotation about the center axis of the shaft 116 at a constant velocity in synchronism with other driven members and units of the loom. The weft release control link means 112 comprises a parallelogrammic four-bar linkage comprising a generally horizontal link lever 122 and a link arm 124 which is parallel with the link lever 122. The link lever 122 has a fulcrum portion rotatably mounted on a stationary shaft 126 having a center axis substantially parallel with the center axis of the above-mentioned cam shaft 116. The link lever 122 further has a first arm portion 128 pivotally connected at its end to the link bar portion 56 of the guide member 52 by a pivotal pin 130 and a second arm portion 132 extending from the fulcrum portion in opposite direction to the first arm portion 128. The pivotal pin 130 has a center axis substantially parallel with the center axis of the shaft 126 supporting the link lever 122. The second arm portion 132 has carried at its leading end a cam follower roller 134 which is rotatable on a pin 136 secured to the arm portion 132 and having a horizontal center axis substantially parallel with the center axis of the cam shaft 116 supporting the intermittent motion cam 114. The link lever 122 thus arranged is urged to turn counterclockwise in FIGS. 1 and 2 about the center axis of the shaft 126 for having the cam follower roller 134 in contact with the cam 114 by suitable biasing means such as a helical tension spring 138 which is shown to be anchored at one end to the above-mentioned second arm portion 132 of the link lever 122 and at the other to a suitable stationary wall portion 140 of, for example, the loom construction. On the other hand, the link arm 124 is rotatable about a stationary shaft 142 having a horizontal axis substantially parallel with the shaft 126 carrying the link lever 122 and is pivotally connected to the link bar portion 56 of the guide member 52 by a pivotal pin 144 having a center axis substantially parallel with the center axis of the shaft 142 and accordingly with the center axis of the previously mentioned pivotal pin 130 on the link portion 56. The stationary shafts 126 and 142 supporting the link lever 122 and the link arm 124, respectively, are fixedly mounted on a suitable stationary structure (not shown) which may form part of the loom construction. The shafts 126 and 142 are, furthermore, positioned relative to each other so that the center axes thereof are situated on a common vertical plane normal to the previously mentioned vertical plane on which the guide member 52 is movable together with the lever actuating means 62. The pivotal pins 130 and 144 on the link portion 56 of the guide member 52 are located so that the distance between the center axes thereof is substantially equal to the distance between the respective center axes of the stationary shafts 126 and 142 and, in addition, the distance between the respective center axes of the shaft 126 and pin 130 interconnected by the first arm portion 128 of the link lever 122 is substantially equal to the distance between the respective center axes of the shaft 142 and pin 144 interconnected by the link arm 124. The previously mentioned parallelogrammic four-bar linkage is thus constructed by the first arm portion 128 of the link lever 122, the link arm 124, the link bar portion of the guide member 52, and the stationary structure (not shown) supporting the stationary shafts 126 and 142. Thus, shafts 126 and 142 constitute the stationary pair-members and the pivotal pins 130 and 144 constitute the moving pair-members in the four-bar linkage. It is apparent that the four-bar linkage constructed in this fashion is deformable on a vertical plane substantially parallel with the plane on which the guide member 52 is vertically movable. In other words, the four-bar linkage is adapted not only to transmit the rotational motion of the cam 114 to the guide member 52 as the linear motion but to constrain the guide member 52 to move upwardly and downwardly in parallel with the plane containing the center axes of the stationary shafts 126 and 142. The link lever 122 being biased to turn counterclockwise in FIGS. 1 and 2 about the center axis of the stationary shaft 126 by the force of the tension spring 138, the parallelogrammic four-bar linkage is urged to move the guide member 52 upwardly. As the intermittent motion cam 114 is driven to rotate about the center axis of the cam shaft 116, the cam follower roller 134 in rolling contact with the cam 114 intermittently rides on the high lobe portion 120 of the cam 114 and is alternately raised and lowered relative to the center axis of the cam shaft 116. When the cam follower roller 134 is thus received on the high cam lobe portion 120 and is raised over the center axis of the cam shaft 116, the link lever 122 is caused to turn clockwise in FIGS. 1 and 2 about the center axis of the stationary shaft 126 and moves the guide member 52 downwardly in cooperation with the link arm 124 which is also turned clockwise in FIGS. 1 and 2 about the center axis of the stationary shaft 142. When the cam follower roller 134 is then brought into contact with the circular lobe portion 118 of the cam 114 and is lowered toward the center axis of the cam shaft 116, the link lever 122 is caused to turn counterclockwise in FIGS. 1 and 2 about the center axis of the shaft 126 and moves the guide member 52 upwardly in cooperation with the link arm 124 which is also turned counterclockwise in FIGS. 1 and 2 about the center axis of the shaft 126. The rotational position of the cam 114 having its low circular lobe portion 118 is herein referred to as a first angular position of the weft selector cam means 110 and the rotational position of the cam 114 having its high lobe portion 120 is herein referred to as a second angular position of the cam means 110. Consonantly, the lowered and raised positions of the guide member 52 and accordingly of the lever actuating means 62 thus achieved when the cam means 110 is in the above first mentioned first and second positions are herein referred to as first and second positions of the guide member 52 and the lever actuating means 62.

While the pinch-off units and the release levers of the weft retaining mechanism 10 and accordingly the cams and cam follower rollers included in the weft selector mechanism 12 have been assumed as four in number respectively, it is apparent the number of such member and units can be selected arbitrarily depending upon the number of the natures, usually colours as previously noted, of the weft yarns to be used. Likewise, the number of the cam lobe portions of each of the cams can be varied depending upon the designs of the control means to which the weft selector cam means 76 is to be connected. Furthermore, the cam 114 of the weft release control cam means 110 may be formed with any number of high lobe portions if desired.

OPERATION

Description will be hereinafter made with reference to FIGS. 1 to 4 in respect of the operation of the above described apparatus according to the present invention.

Throughout the operation of the loom, the cam 114 of the weft release control cam means 110 is kept driven for rotation at a constant velocity about the axis of the cam shaft 116. The cam means 110 is thus intermittently driven between the first and second angular positions thereof so that the guide member 52 and accordingly the lever actuating means 62 of the weft selector mechanism 12 are alternately moved upwardly and downwardly between the first and second positions thereof on the previously mentioned vertical plane parallel with the vertical plane containing center axes of the control rods 24 of the weft pinch-off units 16*a*, 16*b*, 16*c* and 16*d*.

When, under these conditions, any one or more of the second, third and fourth cams 78*b*, 78*c* and 78*d* of the weft selector cam means 76 are driven to turn about the center axis of the cam shaft 80, the bell crank lever 88 is rotated in either direction about the center axis of the stationary shaft 90 between the previously mentioned first, second, third and fourth angular positions and thus move the movable bracket 64 on the guide rail portion 54 of the guide member 52 between the positions aligned with the first, second, third and fourth weft pinch-off units 16*a*, 16*b*, 16*c* and 16*d*. If, for example, the second, third and fourth cams 78*b*, 78*c* and 78*d* are thus turned about the center axis of the cam shaft 80 into the angular positions having one of the cam lobe portions 82*c* of the third cam 78*c* in contact with the third cam follower roller 98*c* and one of the low arc portions 84*d* of the fourth cam 78*d* directed toward the fourth cam follower roller 98*d* as will be seen from FIGS. 2 and 3, the bell crank lever 88 assumes its third angular position so that the previously described movable bracket 64 of the lever actuating means 62 is held in the position aligned with the third weft pinch-off unit 16*c* as will be best seen in FIG. 4 and has the elongated element or bolt 66 located above the flat upper face 40 of the third weft release lever 32*c* (FIGS. 3). If, under these conditions, the weft release control cam means 110 happens to be in the first angular position thereof with the low circular arc portion 118 of the cam 114 contacted by the cam follower roller 134 and, as a consequence, the guide member 52 and the lever actuating means 62 are held in the first or raised positions thereof, the elongated element or bolt 66 on the movable bracket 64 is held in a vertical position allowing the third weft release lever 32*c* to assume its first angular position about the center axis of the stationary shaft 34 and to have its first arm portion 36 contacted by the stop member 42 of the third weft pinch-off unit 16*c* as indicated by full lines in FIG. 3 by the force of the tension spring 46 connected to the third weft release lever 32*c*. The control rod 24 of the third weft release lever 32*c* is therefore allowed to be downwardly moved by the compression spring 28 into its lowermost position holding the movable member 26 against the upper face of the stationary member 20 of the third weft pinch-off unit 16*c*. The third weft pinch-off unit 16*c* is thus held in the previously mentioned first condition having the weft yarn Y*c* retained between the stationary and movable members 20 and 26 of the unit. The weft yarn Y*c* is in this fashion maintained in a detailed condition during a period of time in which the cam 114 of the weft release control cam means 110 is being driven with its low circular arc portion 118 held in rolling contact with the cam follower roller 134 on the link lever 122. When the weft selector cam means 110 is then driven into the previously mentioned second angular position with the high lobe portion 120 of the cam 114 in contact with the cam follower roller 134, then the guide member 52 and the lever actuating means 62 are moved into the second positions thereof by the link means 112 so that the elongated element or bolt 66 on the movable bracket 64 presses the flat upper surface portion 40 of the third weft release lever 32*c* downwardly. The third weft release lever 32*c* is therefore rotated counterclockwise in FIG. 3 about the center axis of the stationary shaft 34 into the previously mentioned second angular position thereof as indicated by phantom lines in FIG. 3 against the opposing force of the tension spring 46. This causes the control rod 24 of the third weft pinch-off unit 16*c* to move upwardly through the axial bore 22 in the stationary member 20 against the compression spring 28 and moves the movable member 26 upwardly away from the upper end face of the stationary member 20 of the unit 16*c*. The third weft pinch-off unit 16*c* is now in the previously mentioned second condition so that the weft yarn Y*c* which has been captured between the stationary and movable members 20 and 26 of the third weft pinch-off unit 16*c* is permitted to longitudinally move relative to the third weft pinch-off unit 16*c* and can be drawn off through the unit 16*c* toward the shed (not shown) formed by warp yarns. The weft yarn Y*c* is in this fashion drawn off cyclically as the cam 114 of the weft release control cam means 110 is intermittently turned into the angular position having its high lobe portion 120 contacted by the cam follower roller 134 as long as the third and fourth cams 78*c* and 78*d* of the weft selector cam means 76 are held in the previously mentioned angular position operative to have the movable bracket 64 positioned in alignment with the third weft pinch-off unit 16*c*.

When the movable bracket 64 is maintained in the position aligned with the third weft pinch-off unit 16*c* as hereinbefore described, each of the weft release levers 32*a*, 32*b* and 32*d* of the first, second and fourth weft pinch-off units 16*a*, 16*b* and 16*d*, respectively, is held in the second angular position thereof with its first arm portion 36 downwardly pressed against the stop member 42 by the force of the tension spring 46. Each of the first, second and fourth weft pinch-off units 16*a*, 16*b* and 16*d* is thus held in the first condition thereof irrespective of the position of the guide member 52 and accordingly the angular position of the weft release control cam means 110 so that each of the weft yarns Y*a*, Y*b* and Y*d* is kept retained to each of the weft pinch-off units 16*a*, 16*b* and 16*d*.

What is claimed is:

1. An apparatus for selectively detaining and releasing a plurality of weft yarns to be drawn off into the shed of a weaving loom including control means incorporating a predetermined schedule for weft selection, comprising in combination (1) a weft retaining mechanism comprising a plurality of weft pinch-off units arranged in a row and each having a first condition operative to detain a weft yarn leading from a yarn package and a second condition allowing the weft yarn to be drawn off through the weft pinch-off unit; and weft release levers respectively in engagement with said weft pinch-off units and each rotatable about a fixed axis between first and second angular positions holding the associated weft pinch-off unit in said first and second conditions thereof, (2) a weft selector mechanism for selecting out of said plurality of weft yarns a weft yarn to be drawn off into the weaving shed under the control of said control means, the selector mechanism comprising weft selector cam means operatively connected to said control means for being driven in accordance with said predetermined schedule; weft selector link means in engagement with said cam means; lever actuating means movable with said link means between positions respectively engageable with said weft release levers, said cam means being movable between angular positions respectively holding the link means in said positions thereof; and a guide member for guiding said lever actuating means to move between said positions thereof relative to the guide member, said guide member and said lever actuating means being movable together between first positions operative to hold each of the weft release levers in the first angular position thereof when the particular weft release lever is being engaged by said lever actuating means and second positions allowing each of the weft release levers to turn into the second angular position thereof when the particular weft release lever is being engaged by the lever actuating means, and (3) a weft release control mechanism comprising weft release control cam means rotatable about a fixed axis and having first and second angular positions for driving said particular release lever into said first and second angular positions, respectively, thereof; and weft release control link means being in engagement with said weft release control cam means and movably connected to said guide member for converting the rotational motion of said weft release control cam means into substantially linear motion and transmitting the linear motion to said lever actuating means through said guide member so that the particular weft release lever being engaged by said lever actuating means is moved into the first and second angular positions thereof in response to the first and second angular positions of said weft release control cam means.

2. An apparatus as set forth in claim 1, in which said weft release levers are substantially equally dimensioned and have a common rotational axis which is coincident with said fixed axis of each weft release lever, said weft pinch-off units being arranged substantially in parallel with common rotational axis of the weft release levers.

3. An apparatus as set forth in claim 2, in which said lever actuating means is movable on said guide member substantially in parallel with said common rotational axis of said weft release levers.

4. An apparatus as set forth in claim 3, in which said guide member and said lever actuating means are movable together substantially perpendicularly to the direction in which said lever actuating means is movable on said guide member.

5. An apparatus as set forth in claim 4, in which said weft selector cam means comprises cams in a number equal to the number of said weft pinch-off units, said cams being rotatable independently of each other about a common fixed axis substantially perpendicular to said direction of movement of said lever actuating means on said guide member and in which said weft selector link means comprises a lever rotatable about a fixed axis substantially parallel with said common fixed axis of rotation of said cams and supporting at one end a plurality of cam followers respectively engageable with said cams, said lever of the weft selector link means being movably connected to said lever actuating means.

6. An apparatus as set forth in claim 5, in which said cams consist of a circular cam and lobular cams each having a plurality of cam lobe portions substantially equiangularly spaced apart from each other across low arc portions about said common fixed axis of the cams and having substantially equal radii of curvature, the low arc portions of all of said lobular cams being substantially equal in radius to said circular cam and the respective cam lobe portions of said lobular cams being different in diameter from each other, said lever of said weft selector link means being rotatable about said axis thereof between two extreme rotational positions and assuming one extreme rotational position when the cam follower associated with said circular cam is in contact with the circular cam and the other extreme rotational position when the cam follower associated with the particular lobular cam having the cam lobe portions with the largest diameter among said lobular cams is in contact with said particular lobular cam, said lever of the weft selector link means being rotatable between said two extreme rotational positions through at least one intermediate rotational position about said axis of rotation thereof when said circular cam and said particular lobular cam are disengaged from the respectively associated cam followers, said lever actuating means being moved into said positions respectively aligned with said weft pinch-off units when said lever of the weft selector link means is moved into said extreme and intermediate rotational positions, respectively.

7. An apparatus as set forth in claim 6, in which said weft selector link means further comprises a link bar pivotally connected at one end to said lever of the weft selector link means and at the other end to said lever actuating means, said link bar being longitudinally movable substantially in parallel with said direction in which said lever actuating means is movable on said guide member.

8. An apparatus as set forth in claim 3, in which said guide member is supported by said weft release control link means, said weft release control link means being configured to constrain said guide member to move on a plane substantially parallel with said common rotational axis of said weft release levers and substantially perpendicularly to the direction in which said lever actuating means is movable on said guide member.

9. An apparatus as set forth in claim 8, in which said weft release control link means comprises a substantially parallelogrammic four-bar linkage connected to said guide member by moving pair-members.

10. An apparatus as set forth in claim 9, in which said parallelogrammic four-bar linkage comprises a link lever rotatable about a fixed axis substantially normal to said plane, said link lever being pivotally connected at one end to said guide member by one of said moving pair-members and being engaged at the other end by said weft release control cam means, and a link arm rotatable about a fixed axis substantially parallel with the axis of rotation of the link lever and pivotally connected to said guide member by the other of said moving pair-members.

11. An apparatus as set forth in claim 10, in which said guide member has a guide rail portion extending in said direction in which said lever actuating means is movable relative to the guide member and a link portion extending substantially in parallel with the plane passing through the respective axes of said link lever and said link arm, said lever actuating means being longitudinally movably supported on said guide rail portion of the guide member and said link lever and said link arm being pivotally connected by said moving pair-members to said link portion of the guide member, the link portion forming part of said parallelogrammic four-bar linkage.

12. An apparatus as set forth in claim 11, in which said weft selector cam means comprises cams in a number equal to the number of said weft pinch-off units, said cams being rotatable independently of each other about a fixed axis substantially normal to said plane and in which said weft selector link means comprises a lever rotatable about a fixed axis substantially parallel with the axis of rotation of said cams and supporting at one end a plurality of cam followers respectively engageable with said cams and a link bar pivotally connected at one end to the other end portion of said lever of the weft selector link means and at the other end to said weft actuating means, said link bar being movable substantially in parallel with said guide rail portion of said guide member.

13. An apparatus as set forth in claim 12, in which said cams consist of a circular cam and lobular cams each having a plurality of cam lobe portions substantially equiangularly spaced apart from each other across low arc portions about the axis of rotation of cams and having substantially equal radii of curvature, the low arc portions of all of said lobular cams having radii substantially equal to the radii of said circular cam and the respective radii of the cam lobe portions of said lobular cams being different from each other, said lever of said weft selector link means being rotatable about said axis thereof between two extreme rotational positions and assuming one extreme rotational position when the cam follower associated with said circular cams is in contact with the circular cam and the other extreme rotational position when the cam follower associated with the particular lobular cam having the cam lobe portions with the largest radii among said lobular cams is in contact with said particular lobular cam, said lever of the weft selector link means being rotatable between said extreme rotational positions through at least one intermediate rotational position about said axis thereof when said circular cam and said particular lobular cam are disengaged from the respectively associated cam followers, said lever actuating means being moved into said positions respectively aligned with said weft pinch-off units when said lever of the weft selector link means is moved into said extreme and intermediate rotational positions, respectively.

14. An apparatus as set forth in claim 13, in which each of said weft pinch-off units comprises a stationary member formed with an axial bore which is open at the axial ends of the stationary member, a control rod axially movable through said bore and having opposite end portions projecting from said axial ends of the stationary member, the respective control rods of said weft pinch-off units having center axes which are situated on a common plane substantially parallel with said plane on which said guide member is movable with said lever actuating means, a movable member secured to one of said end portions of said control rod and movable into and out of contact with one end face of said stationary member, the weft pinch-off unit being in said first condition thereof when said movable member is in contact with said end face of the stationary member and in said second condition when the movable member is spaced apart from the end face of the stationary member, and biasing means urging said movable member toward said end face of the stationary member, said control rod being in engagement at the opposite end thereof with each of said weft release levers.

15. An apparatus as set forth in claim 14, in which said weft retaining mechanism further comprises biasing means urging each of said weft release levers to turn about said axis thereof toward said first angular position thereof.

16. An apparatus as set forth in claim 15, in which said lever actuating means comprises a movable bracket slidable on said guide rail portion of said guide lever substantially in parallel with said common axis of rotation of said weft release levers, and an elongated element mounted on said movable bracket and engageable with each of said weft release levers when the movable bracket is moved on said guide rail portion of said guide member into a position aligned with each weft release lever.

17. An apparatus as set forth in claim 16, in which said elongated element adjustably mounted on said movable bracket so that said first and second angular position of each of said weft release levers relative to said guide member and to the associated weft pinch-off unit are adjustable.

18. An apparatus as set forth in claim 15, in which each of said weft pinch-off units further comprises stop means for preventing the associated weft release lever from being rotated about said fixed axis thereof beyond said first angular position thereof.

* * * * *